US008909075B2

(12) United States Patent
Aoki

(10) Patent No.: US 8,909,075 B2
(45) Date of Patent: Dec. 9, 2014

(54) IMAGE FORMING APPARATUS AND FIXING DEVICE HAVING PAPER DUST AMOUNT OBTAINING UNIT

(71) Applicant: Toshiya Aoki, Toyokawa (JP)

(72) Inventor: Toshiya Aoki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/736,979

(22) Filed: Jan. 9, 2013

(65) Prior Publication Data

US 2013/0177330 A1 Jul. 11, 2013

(30) Foreign Application Priority Data

Jan. 11, 2012 (JP) ..... 2012-003318

(51) Int. Cl.
*G03G 15/20* (2006.01)

(52) U.S. Cl.
USPC ..... 399/33

(58) Field of Classification Search
CPC ..... G03G 15/2039; G03G 15/2078
USPC ..... 399/33, 68, 69, 322, 328, 329; 219/216
See application file for complete search history.

(56) References Cited

U.S. PATENT DOCUMENTS

| | | | | |
|---|---|---|---|---|
| 7,536,123 | B2 * | 5/2009 | Kurita et al. | 399/33 |
| 7,805,090 | B2 * | 9/2010 | Ferencz, Jr. | 399/67 |
| 2008/0008482 | A1 | 1/2008 | Kurita et al. | |
| 2011/0268481 | A1 | 11/2011 | Tetsuno et al. | |

FOREIGN PATENT DOCUMENTS

| | | | | |
|---|---|---|---|---|
| JP | 2000-019872 | A | | 1/2000 |
| JP | 2000-275993 | A | | 10/2000 |
| JP | 2001282019 | A | * | 10/2001 |
| JP | 2004191491 | A | * | 7/2004 |
| JP | 2004-258570 | A | | 9/2004 |
| JP | 2007034028 | A | * | 2/2007 |
| JP | 2007-187859 | A | | 7/2007 |
| JP | 2008-015291 | A | | 1/2008 |
| JP | 2008-139445 | A | | 6/2008 |
| JP | 2009-031551 | A | | 2/2009 |
| JP | 2011-090071 | A | | 5/2011 |
| JP | 2011-232690 | A | | 11/2011 |

OTHER PUBLICATIONS

Office Action (Decision to Grant a Patent) issued on Feb. 4, 2014, by the Japanese Patent Office in corresponding Japanese Patent Application No. 2012-003318, and an English Translation of the Office Action. (3 pages).

* cited by examiner

*Primary Examiner* — Robert Beatty
(74) *Attorney, Agent, or Firm* — Buchanan Ingersoll & Rooney PC

(57) ABSTRACT

A fixing device for performing a thermal fixing for fixing an unfixed image onto a recording sheet by passing the recording sheet through a fixing nip formed by a fixing rotator and a pressing member pressing the fixing rotator. The fixing device obtains a value indicating an amount of paper dust attached to the fixing rotator, and when the amount of paper dust indicated by the obtained value is equal to or larger than a permissible amount, performs a control so that a larger amount of heat is supplied to the recording sheet in the thermal fixing than when the amount of paper dust indicated by the obtained value is smaller than the permissible amount.

12 Claims, 8 Drawing Sheets

FIG. 8

| Evaluation item | Toner smear rank | | Paper jam | |
|---|---|---|---|---|
| Paper type | Paper A | Paper B | Paper A | Paper B |
| Comparative example | 2 | 4 | ○ Not occurred | × Occurred |
| Working example 1 | 2 | 2 | ○ Not occurred | ○ Not occurred |
| Working example 2 | 2 | 2 | ○ Not occurred | ○ Not occurred |
| Working example 3 | 2 | 2 | ○ Not occurred | ○ Not occurred |
| Working example 4 | 2 | 1 | ○ Not occurred | ○ Not occurred |
| Working example 5 | 2 | 1 | ○ Not occurred | ○ Not occurred |

IMAGE FORMING APPARATUS AND FIXING DEVICE HAVING PAPER DUST AMOUNT OBTAINING UNIT

CROSS-REFERENCE TO RELATED APPLICATIONS

This application is based on application No. 2012-003318 filed in Japan, the contents of which are hereby incorporated by reference.

BACKGROUND OF THE INVENTION (1) Field of the Invention

The present invention relates to an image forming apparatus such as a printer or copier provided with a fixing device, and especially to a technology for reducing the paper jam from occurring to a recording sheet having passed through a fixing nip.

(2) Description of the Related Art

An image forming apparatus such as a printer or copier is provided with a fixing device for thermally fixing a toner image (unfixed image) formed on a recording sheet. The fixing device typically includes a fixing rotator, which is a fixing roller or a fixing belt, and a pressing roller. The fixing device causes a recording sheet to pass through a fixing nip which is formed by the fixing rotator and the pressing roller pressing the fixing rotator so that the toner image is thermally fixed onto the recording sheet.

The fixing device is also provided with a separator for separating the recording sheet from the fixing rotator when the recording sheet comes out of the fixing nip after the thermal fixing. In the case where the separator is a sheet separating claw, the tip of the sheet separating claw is located so as to be in contact with the outer surface of the fixing rotator (see Japanese Patent Application Publication No. 2008-139445).

With the above-described structure, when the recording sheet comes out of the fixing nip after a toner image is thermally fixed thereon by passing through the fixing nip, the recording sheet is separated from the fixing rotator by the tip of the sheet separating claw. This prevents occurrence of a paper jam which would occur when the recording sheet having passed through the fixing nip is stuck on the outer circumferential surface of the fixing rotator and does not separate from the fixing rotator.

Meanwhile, in recent years, many recording sheets used in the image forming apparatus contain a large amount of (for example, 10 to 20%) additives such as calcium carbonate to improve the whiteness, smoothness and the like of the sheets. These additives have the property of being likely to attach to the outer circumferential surface of the fixing rotator as the paper dust by the electrostatic phenomenon when they contact with the fixing rotator during the thermal fixing. When such paper dust is attached to the outer circumferential surface of the fixing rotator, the toner may further be attached to the paper dust on the surface. In such a state, when a recording sheet on which a toner image has been formed, passes through the fixing nip, the toner attached to the paper dust sticks to the toner of the recording sheet and the recording sheet is strongly stuck to the outer circumferential surface of the fixing rotator.

When the recording sheet is strongly stuck to the outer circumferential surface of the fixing rotator, it become difficult for the tip of the sheet separating claw to separate the recording sheet from the outer circumferential surface of the fixing rotator, and as a result, the recording sheet is wound around the outer circumferential surface of the fixing rotator, causing a paper jam to occur.

One might think that a cleaning device may be provided to remove the paper dust from the fixing rotator. However, this causes a deficiency that, when provided, the cleaning device removes heat partially from the fixing rotator, thereby decreasing the heating efficiency of the fixing rotator during the warm-up and increasing the time required for the warm-up.

SUMMARY OF THE INVENTION

As a solution to the above-mentioned problems, an aspect of the present invention provides a fixing device for performing a thermal fixing for fixing an unfixed image onto a recording sheet by passing the recording sheet through a fixing nip formed by a fixing rotator and a pressing member pressing the fixing rotator, the fixing device comprising: a paper dust amount obtaining unit configured to obtain a value indicating an amount of paper dust attached to the fixing rotator; and a heat supply controller configured to, when the amount of paper dust indicated by the obtained value is equal to or larger than a permissible amount, perform a control so that a larger amount of heat is supplied to the recording sheet in the thermal fixing than when the amount of paper dust indicated by the obtained value is smaller than the permissible amount.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings:

FIG. 8 illustrates results of an experiment conducted to check the toner smear rank and the occurrence of a paper jam, in comparison between the case where any of the heat supply control processes of the working examples 1 to 4 was performed and the case (comparative example) where none of the heat supply control processes was performed.

DESCRIPTION OF PREFERRED EMBODIMENTS

The following describes an embodiment of the image forming apparatus of the present invention, taking as an example a case where the present invention is applied to a tandem color digital printer (hereinafter, merely referred to as a printer).

[1] Structure of Printer

Figure 1:
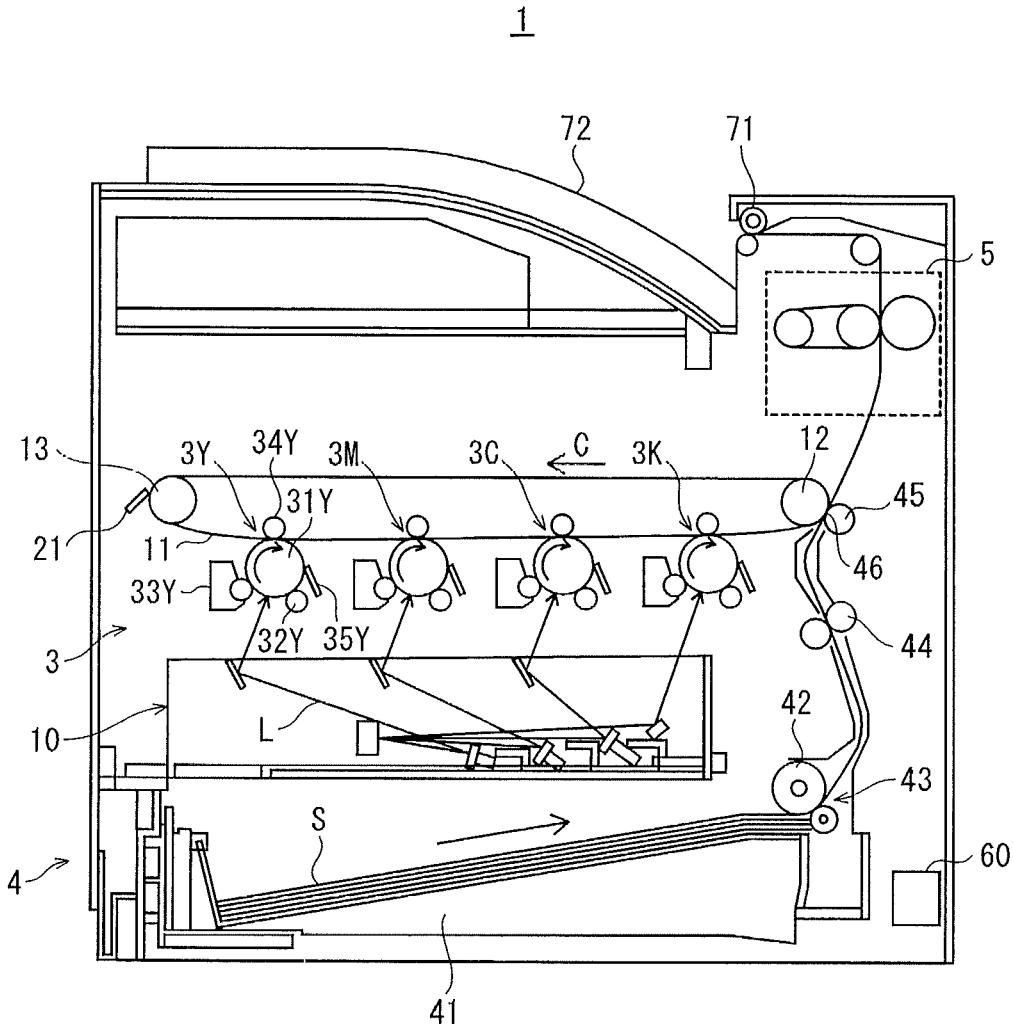
FIG. 1 illustrates a structure of the printer 1.

First, the structure of a printer 1 of the present embodiment is described. FIG. 1 illustrates a structure of a printer 1 in the present embodiment. As shown in FIG. 1, the printer 1 includes an image processor 3, a sheet feeder 4, a fixing device 5, and a controller 60.

The printer 1 is connected to a network (for example, a LAN). Upon receiving an instruction to execute a print job from an external terminal device (not illustrated) via the network, or from an operation panel that includes a display, the printer 1 executes the print job by forming toner images of yellow, magenta, cyan, and black, and forming a full-color image by transferring the toner images of the colors onto a recording sheet by a multi-transfer. Hereinafter, the reproduction colors, yellow, magenta, cyan, and black, are respectively represented as Y, M, C, and K, and Y, M, C, or K will be added to each reference number of the element that is related to the color.

The image processor 3 includes image creating units 3Y, 3M, 3C and 3K, an exposing unit 10, an intermediate transfer belt 11, and a second transfer roller 45. The image creating units 3Y, 3M, 3C and 3K have similar structures. In the following, as a representative, the structure of the image creating unit 3Y is mainly explained.

The image creating unit 3Y includes a photosensitive drum 31Y and also includes a charger 32Y, a developing unit 33Y, a first transfer roller 34Y, and a cleaner 35Y for cleaning the photosensitive drum 31Y, around the photosensitive drum 31Y. The image creating unit 3Y creates a toner image of color Y on the photosensitive drum 31Y. The developing unit 33Y is provided to face the photosensitive drum 31Y, and transports electrically charged toner to the photosensitive drum 31Y. The intermediate transfer belt 11, an endless belt, is suspended with tension between a drive roller 12 and a passive roller 13 and is caused to move cyclically in the direction indicated by the arrow C in the drawing. A cleaning device 21 for removing the toner that has remained on the intermediate transfer belt is provided in the vicinity of the passive roller 13.

The exposing unit 10 is provided with light-emitting elements such as laser diodes, and emits laser beams L to scan the photosensitive drums of the image creating units 3Y, 3M, 3C and 3K with the emitted laser beams, thereby creating images of colors Y-K in accordance with a drive signal received from the controller 60. With this scanning with light, an electrostatic latent image is formed on the surface of the photosensitive drum 31Y that has been electrically charged by the charger 32Y. Similarly, electrostatic latent images are formed on the surfaces of the photosensitive drums of the image creating units 3M, 3C and 3K.

The electrostatic latent images formed on the surfaces of the photosensitive drums are developed by the developing units of the image creating units 3Y, 3M, 3C and 3K, so that toner images of corresponding colors are formed on the photosensitive drums. The toner images thus formed are transferred onto the intermediate transfer belt 11 by the first transfer rollers (in FIG. 1, only the sign 34Y denoting the first transfer roller corresponding to the image creating unit 3Y is illustrated, and signs denoting the other first transfer rollers are omitted) of the image creating units 3Y, 3M, 3C and 3K, wherein the toner images are transferred one by one at different timing so that the images are superimposed at the same position on the intermediate transfer belt 11, this transfer being referred to as a first transfer. The toner images on the intermediate transfer belt 11 are transferred onto a recording sheet at once by the electrostatic action of the second transfer roller 45, this transfer being referred to as a second transfer.

The recording sheet with the toner image transferred thereon by the second transfer is transported to the fixing device 5. The fixing device 5 thermally fixes the toner image (unfixed image) onto the recording sheet by heating and pressing the sheet. The recording sheet is then ejected onto a paper tray 72 by a paper ejecting roller 71.

The sheet feeder 4 includes a sheet feed cassette 41 for holding recording sheets (denoted by sign S in FIG. 1), a feed roller 42 for feeding the recording sheets one by one from the sheet feed cassette 41 onto a transport path 43, and a timing roller 44 for transporting the recording sheets having been fed onto the transport path 43 to a second transfer position 46 at appropriate timings.

It should be noted here that a plurality of sheet feed cassettes, instead of one, may be provided. As the recording sheets, paper sheets of various sizes and thicknesses (regular paper, thick paper, etc.) and film sheets such as OHP sheets can be used. When a plurality of sheet feed cassettes are provided, recording sheets that are different in size, thickness, or material may be housed in the plurality of sheet feed cassettes.

The timing roller 44 transports each recording sheet to the second transfer position 46 at a timing that corresponds to the timing when the toner images, which have been transferred onto the intermediate transfer belt 11 by the first transfer to be superimposed at the same position on the intermediate transfer belt 11, are transported to the second transfer position 46. The toner images on the intermediate transfer belt 11 are transferred onto a recording sheet at once (the second transfer) at the second transfer position 46 by the second transfer roller 45.

Each of the rollers such as the feed roller 42 or the timing roller 44 is powered by a motor (not illustrated), and is driven to rotate via a power transmission mechanism (not illustrated) such as gears and/or a belt. As the motor, a stepping motor, which can control the rotational speed with high accuracy, may be used, for example.

[2] Structure of Fixing Device

Figure 2:
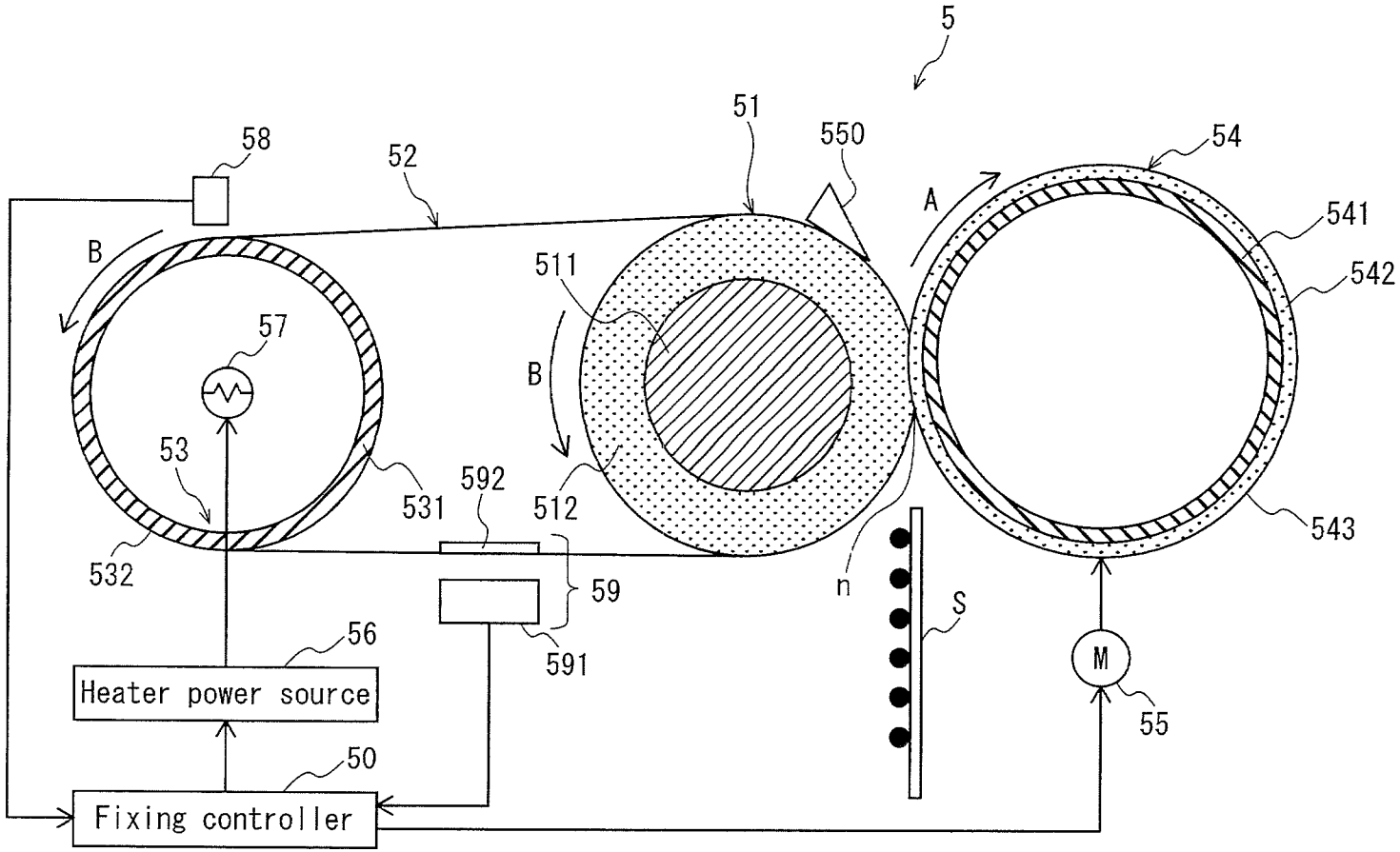
FIG. 2 is a cross-sectional view illustrating the structure of the fixing device 5.

The following describes the structure of a fixing device 5. FIG. 2 is a cross-sectional view illustrating the structure of the fixing device 5. The sign S in FIG. 2 indicates a recording sheet on which an unfixed image has been formed. As illustrated in FIG. 2, the fixing device 5 includes a fixing controller 50, a fixing roller 51, a heating roller 53, a fixing belt 52 that is suspended with tension between the fixing roller 51 and the heating roller 53, a pressing roller 54 for forming a fixing nip n by pressing the fixing roller 51 via the fixing belt 52, a pressing roller driving motor 55 for driving the pressing roller 54 to rotate, a heater power source 56, a heater 57, a temperature sensor 58, a surface potential detecting device 59, and a sheet separating claw 550 provided such that its tip is in contact with the outer surface of the fixing belt 52 in the vicinity of the exit of the fixing nip n. The operation of the fixing device 5 as a whole is controlled by the fixing controller 50.

The fixing roller 51, fixing belt 52, and heating roller 53 rotate passively in the direction indicated by the arrow B when the pressing roller 54 is driven by the pressing roller driving motor 55 to rotate in the direction indicated by the arrow A. The fixing controller 50 controls the driving of the pressing roller driving motor 55, thereby controlling the rotational speeds of the fixing belt 52 and the pressing roller 54.

The temperature sensor 58 for detecting the temperature of the fixing belt 52 is provided in a region that faces the heating roller 53 across the paper-passing region of the fixing belt 52. The fixing controller 50 controls the heating of the heating roller 53 depending on the temperature detected by the temperature sensor 58 so that the temperature of the fixing belt 52 reaches a target temperature (for example, 180° C.).

More specifically, the fixing controller 50 controls the heating of the heating roller 53 so that the temperature of the fixing belt 52 reaches the target temperature, by controlling the ON/OFF of the heater power supply 56 which supplies power to the heater 57 provided inside the heating roller 53.

Here, the "target temperature" is adopted on the perspective of reducing the amount of power consumed in the thermal fixing operation, and is set to the lowest fixing temperature (in this example, it is presumed to be 180° C.) within a range of fixing temperatures at which the unfixed image can be thermally fixed on the recording sheet without problem. The target temperature may be set to a different fixing temperature depending on the type of the recording sheet (thick, regular, thin, etc.) or the printing condition (monochrome printing, color printing, etc.).

Also, the surface potential detecting device 59 for measuring the surface potential of the paper-passing region of the fixing belt 52 is provided in a region that is on the downstream side of the heating roller 53 and on the upstream side of the fixing roller 51 in the rotational direction (the rotational direction when the fixing nip n is defined as the starting point) of the fixing belt 52, the region facing the paper-passing region of the fixing belt 52. The fixing controller 50 obtains the measured value of the surface potential from the surface potential detecting device 59 as a value that indicates the amount of paper dust that has attached to the surface of the fixing belt 52, and performs a heat supply control process which is described below.

The surface potential detecting device 59 includes: a detecting sensor 591 facing the paper-passing region of the outer circumferential surface of the fixing belt 52, without contact therewith; and a metal plate 592 provided to contact the inner circumferential surface of the fixing belt 52, and face the detecting sensor 591 across the fixing belt 52. In the present example, an electrostatic voltmeter (manufactured by Trek Inc., Model 344) is used as the surface potential detecting device 59.

The fixing roller 51 includes a cylindrical cored bar 511 made of a metal, and an elastic layer 512 coating the cored bar 511. The fixing roller 51 may be a roller that is, for example, 20 to 50 mm in outer diameter, wherein the elastic layer 512 that is 2 to 10 mm thick is formed on the outer circumferential surface of the cylindrical cored bar 511 that is 2 to 5 mm in wall thickness. The cored bar 511 may be made of a metal such as aluminum, iron, or SUS (Steel Use Stainless). The elastic layer 512 may be made of an elastic material such as silicone rubber or silicone sponge.

Figure 3:
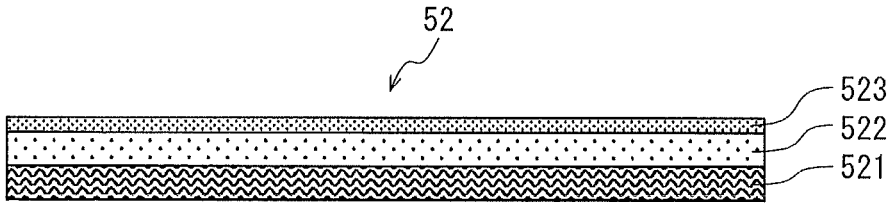
FIG. 3 is a cross-sectional view illustrating the structure of the fixing belt 52.

The fixing belt 52 is an endless belt to be driven to move cyclically and is heated by the heating roller 53 to melt the unfixed image on the recording sheet S when contacted with the recording sheet S during the thermal fixing operation. FIG. 3 is a cross-sectional view illustrating the structure of the fixing belt 52. The fixing belt 52 includes a base layer 521, an elastic layer 522 and a releasing layer 523 which are laminated in this order. As one example, the fixing belt 52 may be a belt that is 60 to 120 mm in outer diameter, wherein the base layer 521 is 50 to 100 μm thick, the elastic layer 522 is 50 to 200 μm thick, and the releasing layer 523 is 10 to 30 μm thick.

The base layer may be made of a heat-resistant resin such as polyimide polyamide. The elastic layer 522 may be made of a heat-resistant elastic material such as silicone rubber. The releasing layer 523 may be made of, for example, a fluorine resin such as PFA (tetrafluoroethylene perfluoroalkoxyethylene copolymer), PTFE (polytetrafluoroethylene), FEP (tetrafluoroethylene hexafluoroethylene copolymer), or PFEP (tetrafluoroethylene hexafluoropropylene copolymer).

Back to the explanation with reference to FIG. 2, the heating roller 53 includes a cylindrical, hollow cored bar 531 made of a metal, and a coat layer 532 coating the outer circumferential surface of the cored bar 531. A heater 57 is provided inside (in the hollow of) the cored bar 531. The heating roller 53 may be a roller that is, for example, approximately 25 mm in outer diameter (the cored bar 531 is approximately 1 mm thick, and the coat layer 532 is approximately 20 μm thick). The cored bar 531 may be made of a metal such as aluminum, iron, or SUS (Steel Use Stainless). The coat layer 532 is provided to prevent the heating roller 53 from degrading due to wear with the fixing belt 52. The coat layer 532 may be made of, for example, PTFE. Also, the heater 533 may be, for example, a halogen heater lamp of 999 W and light-emitting length of 290 mm.

The pressing roller 54 includes a cylindrical, hollow cored bar 541 made of a metal, an elastic layer 542 coating the outer circumferential surface of the cored bar 541, and a releasing layer 543 coating the outer circumferential surface of the elastic layer 542. The pressing roller 54 may be a roller that is, for example, 35 mm in outer diameter (the cored bar 541 is 2 mm thick, the elastic layer 542 is 4 mm thick, and the releasing layer 543 is approximately 30 μm thick).

The cored bar 541 may be made of a metal such as aluminum, iron, or SUS (Steel Use Stainless). The elastic layer 542 may be made of an elastic material such as silicone rubber, silicone sponge, or fluorine-containing rubber. The releasing layer 543 may be made of the same material as the releasing layer 523 of the fixing belt 52.

Note that, although not illustrated, the fixing device 5 is provided with a frame that supports both two ends, in the longitudinal direction, of each of the fixing roller 51, heating roller 53, and pressing roller 54, and covers these rollers. In this frame, gaps are provided as necessary at the entry/exit through which the recording sheet enters and exits, and in the vicinity of the portions where both two ends, in the longitudinal direction, of each of the fixing roller 51, heating roller 53, and pressing roller 54 are supported.

[3] Structure of Controller

Figure 4:
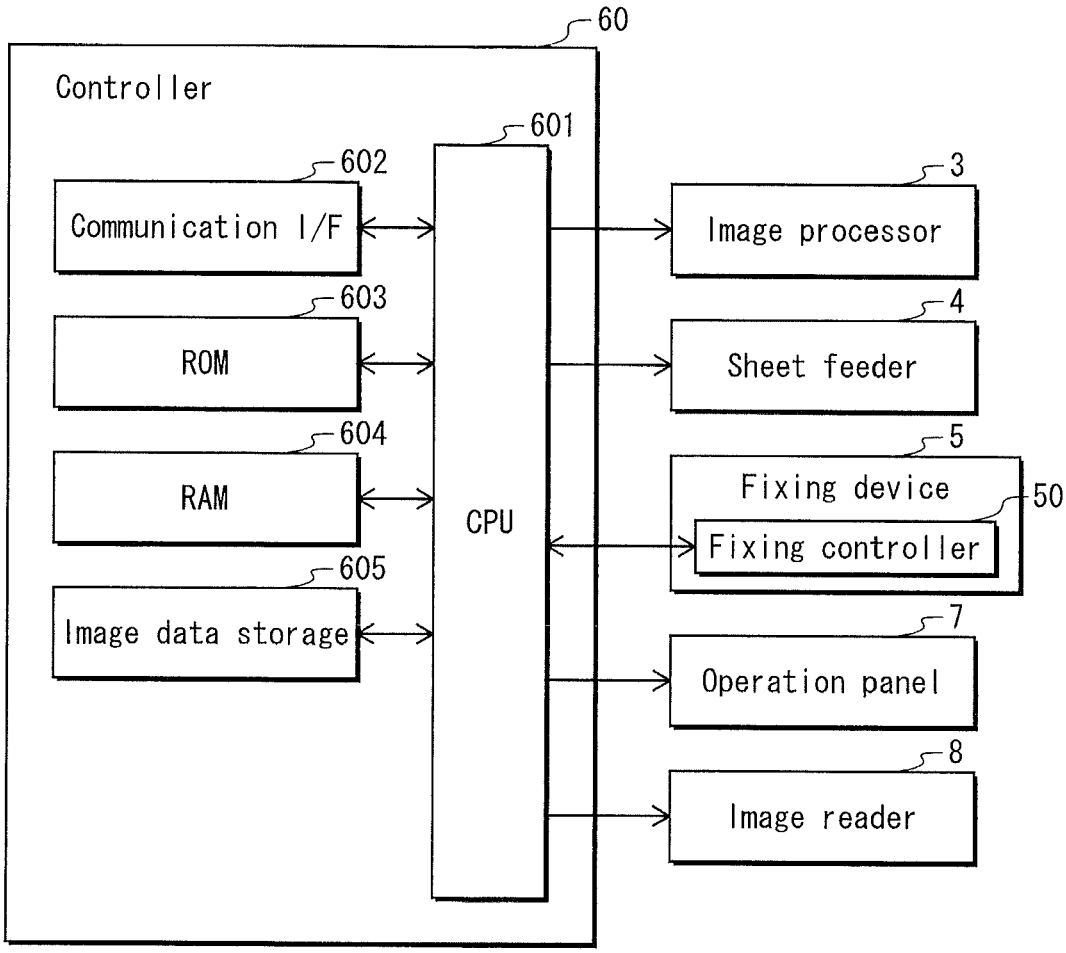
FIG. 4 is a diagram illustrating the structure of the controller 60 and the relationship between the controller 60 and the main structural elements targeted to be controlled by the controller 60.

FIG. 4 is a diagram illustrating the structure of the controller 60 and the relationship between the controller 60 and the main structural elements targeted to be controlled by the controller 60. The controller 60 is a so-called computer, and as illustrated in FIG. 4, includes a CPU (Central Processing Unit) 601, a communication interface (I/F) 602, a ROM (Read Only Memory) 603, a RAM (Random Access Memory) 604, and an image data storage 605.

The communication I/F 602 is an interface, such as a LAN card or a LAN board, for connecting to a LAN. The ROM 603 stores, for example, programs for controlling the image processor 3, sheet feeder 4, fixing device 5, operation panel 7, image reader 8 and the like.

The RAM 604 is used as a work area by the CPU 601 when it executes a program.

The image data storage 605 stores image data for printing which is input via the communication I/F 602 or image reader 8.

The CPU 601 controls the image processor 3, sheet feeder 4, fixing device 5, operation panel 7, image reader 8 and the like by executing the various types of programs stored in the ROM 603. The CPU 601 is structured to be able to communicate with the fixing controller 50, and controls the fixing device 5 via the fixing controller 50.

Figure 5:
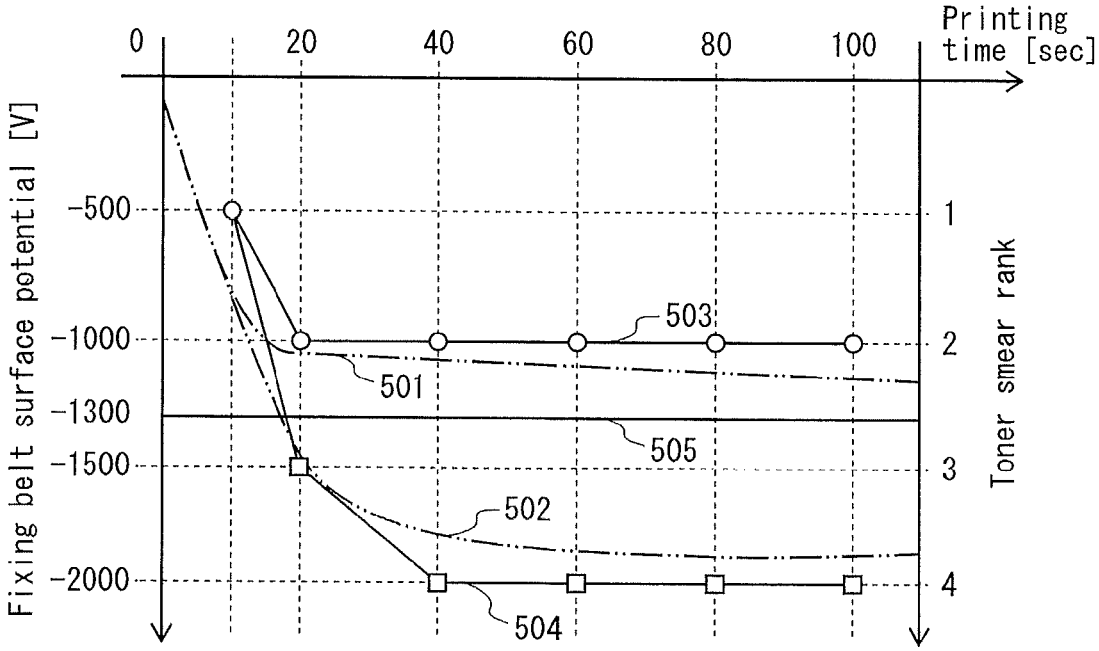
FIG. 5 illustrates results of an experiment conducted to determine the relationship between a plurality of types of recording sheets and the amount of paper dust attached to the fixing belt.

[4] Relationship Between Attachment of Paper Dust to Fixing Belt and Occurrence of Paper Jam FIG. 5 illustrates results of an experiment conducted to determine the relationship between a plurality of types of recording sheets and the amount of paper dust attached to the fixing belt. In the experiment, (1) a type of paper having a high degree of whiteness, more specifically, a type of paper whose whiteness is at least 90% based on the JIS standard (hereinafter, such a type of paper is referred to as "high-whiteness-degree paper"), and (2) a type of paper having a low degree of whiteness, more specifically, a type of paper whose whiteness is 70 to 80% based on the JIS standard (hereinafter, such a type of paper is referred to as "low-whiteness-degree paper"), were respectively subjected to a printing process for 100 seconds at a printing speed of 35 sheers per minute by using the printer 1, and after the printing process, a comparison was made between the high-whiteness-degree paper and the low-whiteness-degree paper, with regard to the amount of paper dust that had attached to the fixing belt 52 during the printing process.

For the detection of the amount of attached paper dust, the surface potential detecting device 59 measured a change in the surface potential of the fixing belt that had occurred due to the attachment of the paper dust. Also, the level of smear (size, the number of smears, etc.) on the fixing belt was evaluated visually by ranking (In this experiment, the smear was ranked one of 1 to 4, where the rank increases as the level of smear increases. Hereinafter the rank is referred to as "toner smear rank".) at predetermined times after the start of the printing process (in this experiment, after 10 seconds, 20 seconds, 40 seconds, 60 seconds, 80 seconds, and 100 seconds from the start).

The two-dot chain line 501 in FIG. 5 indicates the change over time of the surface potential of the fixing belt 52 which was measured in the printing process performed on the low-whiteness-degree paper; and the two-dot chain line 502 in FIG. 5 indicates the change over time of the surface potential of the fixing belt 52 which occurred in the printing process performed on the high-whiteness-degree paper.

Also, the solid line 503 in FIG. 5 indicates the change over time of the toner smear rank in the printing process performed on the low-whiteness-degree paper; and the solid line 504 in FIG. 5 indicates the change over time of the toner smear rank in the printing process performed on the high-whiteness-degree paper.

A comparison of the results indicates that, in the case of the low-whiteness-degree paper, the decrease of the surface potential of the fixing belt 52 is smaller than the high-whiteness-degree paper, and the surface potential was always above −1300 V that is indicated by the solid line 505, while in the case of the high-whiteness-degree paper, the surface potential of the fixing belt 52 became lower than −1300 V within 20 seconds from the start of the printing process, and further decreased to a value close to −2000 V before the printing process ends. The results of the experiment indicate that the amount of paper dust attached to the fixing belt 52 is larger during the printing process performed on the high-whiteness-degree paper than during the printing process performed on the low-whiteness-degree paper.

It is further confirmed that the toner smear rank increases as the surface potential of the fixing belt 52 decreases, and that the toner is more likely to be attached to the fixing belt 52 when more amount of paper dust is attached to the fixing belt 52.

Figure 6A:
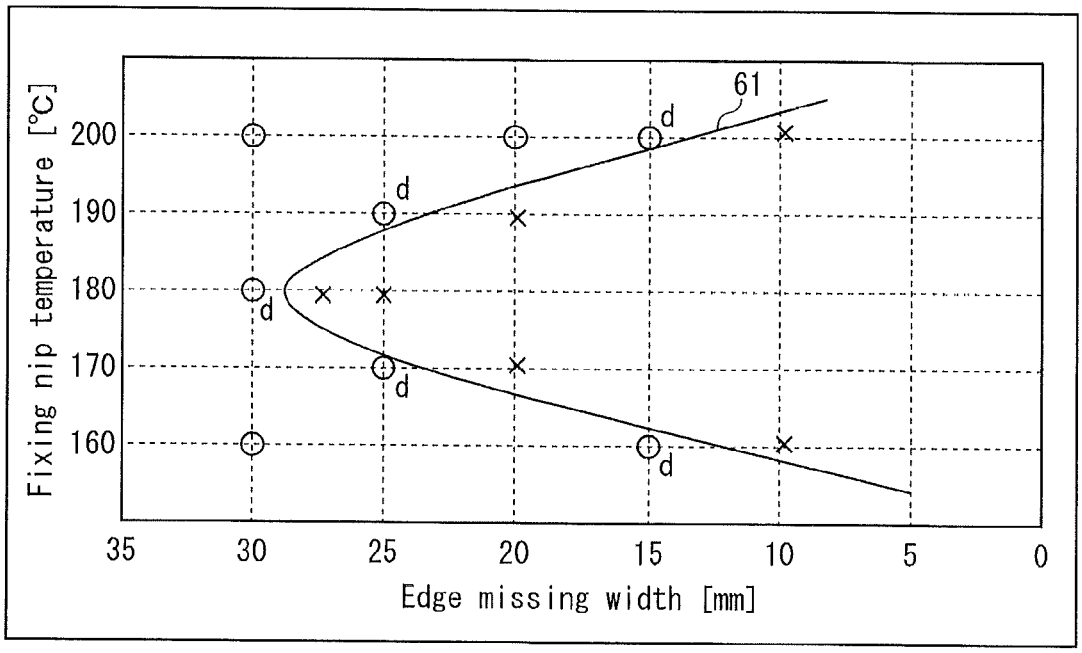
FIGS. 6A and 6B illustrate results of an experiment conducted to determine the relationship between the amount of heat supplied from the fixing nip to the recording sheet and the paper jam restriction effect, in the case where the amount of paper dust attached to the fixing belt 52 corresponds to the case where the surface potential of the fixing belt 52 is not higher than −1300 V.

FIG. 6A illustrates results of an experiment conducted to determine the relationship between the amount of heat supplied from the fixing nip to the recording sheet and the paper jam restriction effect, in the case where the amount of paper dust attached to the fixing belt 52 corresponds to the case where the surface potential of the fixing belt 52 is not higher than −1300 V.

Figure 6B:
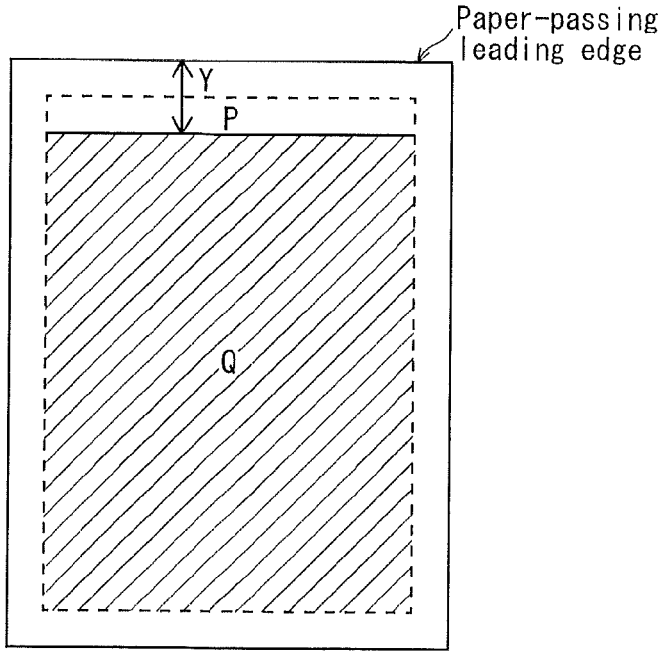

As illustrated in FIG. 6B, in the experiment, a patch toner image represented by the slant lines was formed in a region (Q), which is a region obtained by excluding a region (P) from an image-formable region (the rectangular region encircled by a dotted line in FIG. 6B) on the recording sheet (in this experiment, the high-whiteness-degree paper), the region P extending from the leading edge of the image-formable region, wherein the distance between (i) the leading edge of the recording sheet in the direction in which the recording sheet is passed through the fixing nip n (hereinafter, the edge is referred to as "paper-passing leading edge") and (ii) the trailing edge of the region P (hereinafter the distance between (i) and (ii) is referred to as an "edge missing width"), is a predetermined distance (Y). Subsequently, the patch toner image was thermally fixed onto the recording sheet by using the fixing device 5, and then it was checked whether a paper jam occurred.

The occurrence of a paper jam was checked for each of the cases where the predetermined distance (Y) was 30 mm, 25 mm, 20 mm, 15 mm, and 10 mm, respectively.

In the experiment for checking whether a paper jam occurs for each of different distances, the thermal fixing of the patch toner image was conducted by varying the amount of heat supplied from the fixing nip to the recording sheet (in this experiment, by varying the temperature (T) in the fixing nip n within the range of the target temperature (180° C.)±20° C.).

The sign ○ (circle) in FIG. 6A indicates "paper jam did not occur", and the sign x (cross) indicates "paper jam occurred". Also, the curve 61 is a curve generated based on the results of whether or not paper jam occurred for each of temperatures (T) 160° C., 170° C., 180° C., 190° C., and 200° C., and indicates the size of the paper jam restriction effect for each temperature.

In this curve, the size of the paper jam restriction effect is indicated by the value of the edge missing width, and the edge missing width in this curve corresponds to the shortest edge missing width (the edge missing width indicated by the sign ○ with the sign d in FIG. 6A) among edge missing widths with which paper jam did not occur in each temperature, among all the edge missing widths for which it was checked for each temperature whether or not a paper jam occurred. This curve suggests that the shorter the edge missing width is, the higher the paper jam restriction effect is.

This is because, as the edge missing width becomes shorter and the patch toner image formation start position becomes closer to the paper-passing leading edge, it becomes more difficult for the sheet separating claw 550 to separate the recording sheet from the fixing belt 52 when the toner attached to the fixing belt 52 sticks to the toner of the patch toner image on the recording sheet, and it becomes more likely for a paper jam to occur.

That is to say, if a paper jam did not occur with a shorter edge missing width, it means that a paper jam did not occur in a condition where there was a higher possibility of a paper jam occurring, and the result can be evaluated as having a high paper jam restriction effect.

As indicated by the curve 61 in FIG. 6A, the paper jam restriction effect is lowest when the temperature T in the fixing nip is equal to the target temperature, and the paper jam restriction effect becomes higher as the temperature T becomes lower or higher than the target temperature. Therefore, by setting the temperature T to be higher than the target temperature, it is possible to prevent a fixing defect from occurring and enhance the paper jam restriction effect. On the other hand, when the temperature T is set to be lower than the target temperature, the amount of heat supplied from the fixing nip n to the recording sheet is reduced although the paper jam restriction effect is enhanced, and a fixing defect occurs.

In this way, the paper jam restriction effect is enhanced when the temperature T is set to be higher than the target temperature. The reason for this is considered that the melting of the wax contained in the toner is accelerated when the amount of heat supplied from the fixing nip n to the recording sheet is increased, and the melting of the wax increases the releasability of the toner.

In general, the waxes that may be contained in the toner are, for example: polyolefin wax such as polyethylene wax or polypropylene wax; long-chain hydrocarbon wax such as paraffin wax or sasol wax; ester wax such as trimethylolpropane tribehenate or pentaerythritol tetramyristate; amide wax such as ethylenediamine dibehenyl amide; dialkyl ketone wax such as distearyl ketone; carnauba wax; and montan wax.

The toner stored in each developing unit of the printer 1 in the present embodiment is presumed to contain at least one of the above-listed types of wax.

[5] Heat Supply Control Process

The fixing device 5 of the present embodiment performs a heat supply control process, which is described below, during the thermal fixing operation. In the heat supply control process, the fixing device obtains a measured value of the surface potential of the fixing belt 52 as a value indicating an amount of paper dust having been attached to the fixing belt 52, and when the amount of attached paper dust indicated by the measured value becomes equal to or larger than a permissible amount, performs a control so that a larger amount of heat is supplied from the fixing nip n to the recording sheet than when the amount of attached paper dust is smaller than the permissible amount.

Figure 7:
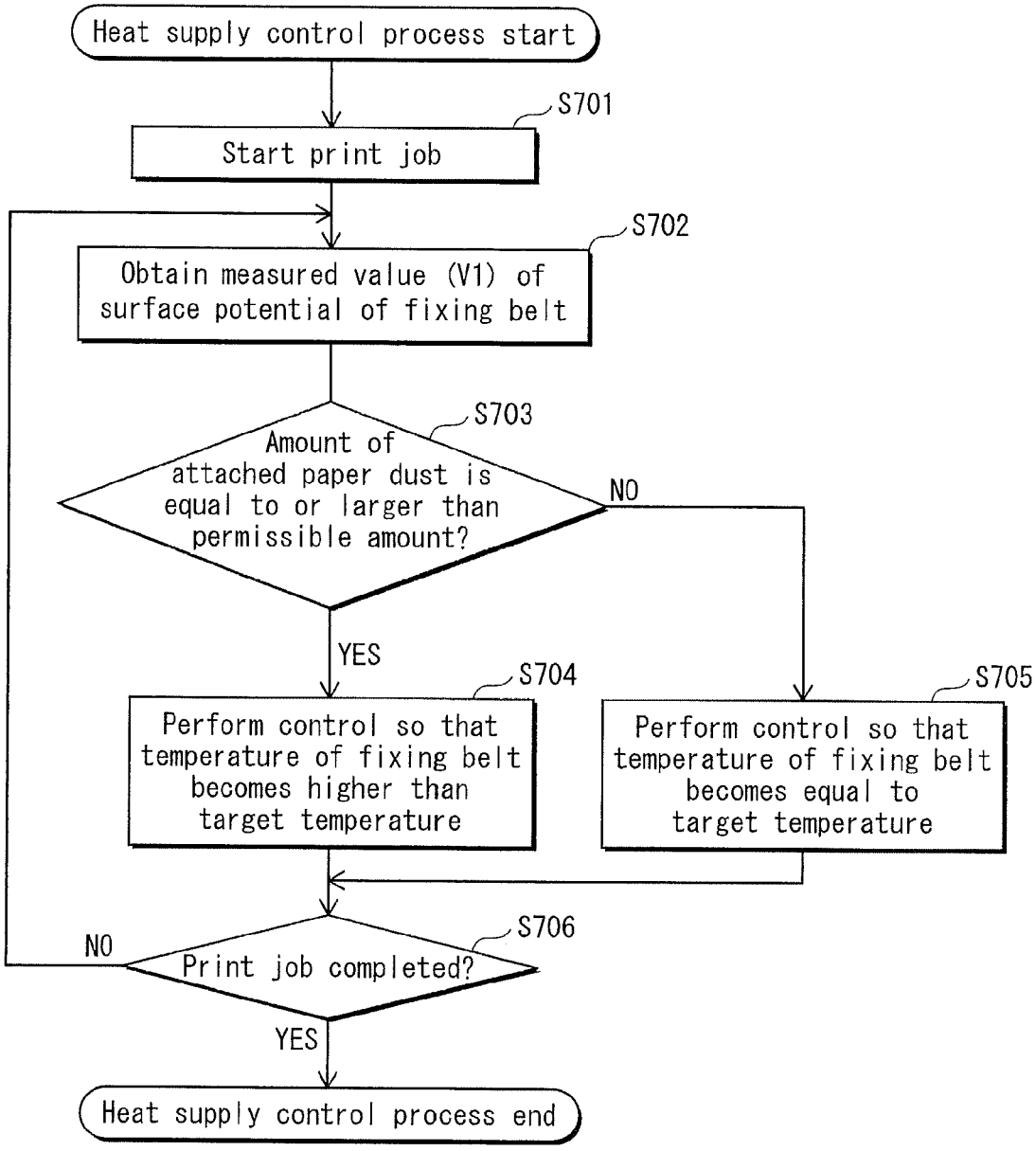
FIG. 7 is a flowchart illustrating the procedure of the heat supply control process performed by the fixing controller 50.

FIG. 7 is a flowchart illustrating the procedure of the heat supply control process performed by the fixing controller 50.

Upon receiving an instruction to start a print job, the fixing controller 50 performs a control so that the temperature of the fixing belt 52 becomes equal to the target temperature by controlling, in response to the temperature detected by the temperature sensor 58, the ON/OFF of the heater power supply 56 which supplies power to the heater 57 provided inside the heating roller 53, and starts the recording sheet thermal fixing operation (step S701). Subsequently, the fixing controller 50 obtains a measured value (V1) of the surface potential from the surface potential detecting device 59 as a value that indicates the amount of paper dust that has attached to the surface of the fixing belt 52 (step S702), and judges whether or not the amount of attached paper dust is equal to or larger than a permissible amount (step S703).

Here, whether or not the amount of attached paper dust is equal to or larger than the permissible amount is determined based on whether or not the measured value V1 is equal to or lower than a threshold value (in the present embodiment, the threshold value is set to −1300 V based on the experiment results illustrated in FIG. 5). More specifically, when the measured value V1 is equal to or lower than the threshold value, it is judged that the amount of attached paper dust is equal to or larger than the permissible amount, and when the measured value V1 is higher than the threshold value, it is judged that the amount of attached paper dust is smaller than the permissible amount.

When it is judged that the amount of attached paper dust is equal to or larger than the permissible amount (step S703: YES), the fixing controller 50 performs a control so that the temperature of the fixing belt 52 becomes higher (in this example, becomes 190° C.) than the preliminarily set target temperature by controlling the ON/OFF of the heater power supply 56 which supplies power to the heater 57 (step S704).

When it is judged that the amount of attached paper dust is smaller than the permissible amount (step S703: NO), the fixing controller 50 performs a control so that the temperature of the fixing belt 52 becomes equal to the target temperature (in this example, 180° C.) by controlling the ON/OFF of the heater power supply 56 which supplies power to the heater 57 (step S705).

The fixing controller 50 repeats the process of steps S703 through S705 until the print job is completed (step S706: YES).

As described above, according to the present embodiment, when the amount of paper dust attached to the fixing belt 52 becomes equal to or larger than the permissible amount, and a paper jam of recording sheet is likely to occur due to the attachment of paper dust during the thermal fixing, a control is performed so that the temperature of the fixing belt 52 becomes higher than the target temperature, and the amount of heat supplied from the fixing nip n to the recording sheet is increased. This accelerates the melting of the wax contained in the toner and enhances the releasability of the toner. As a result, it becomes difficult for the toner on the recording sheet to stick to the toner attached to the paper dust on the fixing-belt 52, thereby enhancing the paper jam restriction effect, and reducing the occurrence of paper jam that is attributable to the attachment of paper dust to the fixing belt 52.

In the heat supply control process illustrated in FIG. 7, the amount of heat supplied from the fixing nip n to the recording sheet is controlled by controlling the temperature of the fixing belt 52. As a modification to this, the amount of heat supplied from the fixing nip n to the recording sheet may be controlled by controlling the speed at which the recording sheet passes through the fixing nip n (hereinafter this modification is referred to as "Modification 1").

More specifically, when the amount of attached paper dust is equal to or larger than the permissible amount, the fixing controller 50 may perform a control so that the pressing roller 54 rotates at a slower speed than when the amount of attached paper dust is smaller than the permissible amount, by controlling the driving of the pressing roller driving motor 55, while maintaining the same amount of power to be supplied to the heater 57 as when the amount of attached paper dust is smaller than the permissible amount. In this case, in response to the above control, the controller 60 controls the paper transport speed of the recording sheet fed by the sheet feeder 4, the speed at which the image processor 3 forms an image, the timing at which the timing roller 44 is driven, and so on.

With the above control of Modification 1, it takes more time for the recording sheet to pass through the fixing nip than when the amount of attached paper dust is smaller than the permissible amount, and as in the heat supply control process illustrated in FIG. 7, the amount of heat supplied from the fixing nip n to the recording sheet is increased, thereby reducing the occurrence of paper jam that is attributable to the attachment of paper dust to the fixing belt 52.

Furthermore, instead of controlling the paper transport speed, the amount of heat supplied from the fixing nip n to the recording sheet may be controlled by controlling the distance from a trailing edge of a preceding recording sheet to a leading edge of a succeeding recording sheet passing through the fixing nip n (hereinafter this distance is referred to as "sheet-to-sheet distance" and this modification is referred to as "Modification 2").

More specifically, when the amount of attached paper dust is equal to or larger than the permissible amount, the fixing controller 50 may communicate with the controller 60 and perform a control so that the sheet feeder 4 feeds the recording sheet at a later timing than when the amount of attached paper dust is smaller than the permissible amount, while maintaining the same amount of power to be supplied to the heater 57 as when the amount of attached paper dust is smaller than the permissible amount, thereby causing the sheet-to-sheet distance between successive recording sheets to be longer. In this case, in response to the above control, the controller 60 controls the speed at which the sheet feeder 4 feeds the recording sheet, the speed at which the image processor 3 forms an image, the timing at which the timing roller 44 is driven, and so on.

With the above control of Modification 2, recording sheets pass through the fixing nip n with less frequency than when the amount of attached paper dust is smaller than the permissible amount, which reduces the amount of heat removed from the fixing nip n when it contacts recording sheets per unit time, and as a result, a more amount of heat is supplied from the fixing nip n to the recording sheet than when the amount of attached paper dust is smaller than the permissible amount. With the above control, as in the heat supply control process illustrated in FIG. 7, it is possible to reduce the occurrence of paper jam that is attributable to the attachment of paper dust to the fixing belt 52.

[6] Effects of Heat Supply Control Process

An experiment was conducted in the printing processes in which the high-whiteness-degree paper and the low-whiteness-degree paper were used, respectively, to check the toner smear rank and the occurrence of a paper jam, in comparison between the case where any of the heat supply control processes of the following working examples 1 to 5 was performed and the case (comparative example) where none of the heat supply control processes was performed.

Working Example 1 the heat supply control process of the present embodiment was performed.

Working Example 2 the heat supply control process of Modification 1 was performed, and the paper transport speed (the rotational speed of the pressing roller 54) when the amount of attached paper dust is equal to or larger than the permissible amount was 100 mm/sec, and the paper transport speed (the rotational speed of the pressing roller 54) when the amount of attached paper dust is smaller than the permissible amount was 200 mm/sec.

Working Example 3 the heat supply control process of Modification 2 was performed, and the sheet-to-sheet distance between successive recording sheets that are passed through the fixing nip n when the amount of attached paper dust is equal to or larger than the permissible amount was 60 mm, and the sheet-to-sheet distance when the amount of attached paper dust is smaller than the permissible amount was 30 mm.

Working Example 4 the heat supply control process according to a combination of working examples 1 and 2 was conducted.

Working Example 5 the heat supply control process according to a combination of working examples 1 and 3 was conducted.

Note that the experiment was conducted in the same experimental conditions as the experiment illustrated in FIG. 5, and with regard to the "toner smear rank", the rank values after 100 seconds from the start of the printing process were compared. Also, in the working example 1, the paper transport speed was 200 mm/sec, and the sheet-to-sheet distance was 30 mm.

FIG. 8 is a table illustrating the results of the above experiment. As illustrated in FIG. 8, when the low-whiteness-degree paper (paper A) was used, the rank value of the toner smear rank was "2" and the paper jam did not occur in all the examples. In contrast, the rank value of the toner smear rank was "4", which indicates the worst smear level, and the paper jam occurred when the high-whiteness-degree paper (paper B) was used in the comparative example in which none of the heat supply control processes of the working examples 1 to 5 was performed.

On the other hand, in the working examples 1 to 5 in which the respective heat supply control processes were conducted, the rank value of the toner smear rank was "2" or "1" and the paper jam did not occur. In the working examples 4 and 5 in each of which the heat supply control process according to a combination of two working examples was conducted, the rank value of the toner smear rank was lower by one rank, and the toner smear on the fixing belt 52 was less, compared to the working examples 1 to 3 in each of which the heat supply control process of a single working example was conducted.

It is confirmed from the results of the experiment that, when the high-whiteness-degree paper (paper B) is used in the printing process, the paper jam is prevented from occurring and the toner smear on the fixing belt 52 is reduced when any of the heat supply control processes of the working examples 1 to 5 is performed, compared to the case (comparative example) where none of the heat supply control processes.

(Modifications)

Up to now, the present invention has been described specifically through the embodiment. However, the present invention is not limited to the above-described embodiment, but may be modified variously as in the following.

(1) In the present embodiment, the heat supply control process illustrated in FIG. 7 is performed by a fixing device using a fixing belt. Not limited to this, however, the heat supply control process of the present embodiment can be applied similarly to a fixing device using a fixing rotator other than a fixing belt. For example, a fixing device in which a fixing roller is used as the fixing rotator, and the fixing nip is formed by the fixing roller and the pressing roller without using the fixing belt, may be used instead of the fixing device 5 of the present embodiment.

Also, a pressing member including: an endless pressing belt to be driven to move cyclically; and a pressure member that presses the fixing rotator via the pressing belt from the inside of the cyclical movement path of the pressing belt, may be used instead of the pressing roller.

(2) In the present embodiment, the surface potential in the paper-passing region of the fixing belt 52 is measured, and the measured value is used as a value that indicates the amount of paper dust attached to the surface of the fixing belt 52. However, the value that indicates the amount of attached paper dust may be obtained by another method other than the method of measuring the surface potential. For example, the optical reflectivity at the surface of the paper-passing region of the fixing belt 52 may be measured, and the measured value may be used as the value that indicates the amount of attached paper dust.

SUMMARY

An aspect of the present invention disclosed above provides a fixing device for performing a thermal fixing for fixing an unfixed image onto a recording sheet by passing the recording sheet through a fixing nip formed by a fixing rotator and a pressing member pressing the fixing rotator, the fixing device comprising: a paper dust amount obtaining unit configured to obtain a value indicating an amount of paper dust attached to the fixing rotator; and a heat supply controller configured to, when the amount of paper dust indicated by the obtained value is equal to or larger than a permissible amount, perform a control so that a larger amount of heat is supplied to the recording sheet in the thermal fixing than when the amount of paper dust indicated by the obtained value is smaller than the permissible amount.

In the above-described fixing device, the fixing rotator may be an endless fixing belt. Also, the value indicating the amount of paper dust may be a measured value of a surface potential in a paper-passing region of the fixing rotator. Furthermore, another aspect of the present invention provides an image forming apparatus that includes the above-described fixing device.

With the above-described structure, when the amount of paper dust attached to the fixing rotator becomes equal to or larger than the permissible amount, and a paper jam of recording sheet is likely to occur due to the attachment of paper dust during the thermal fixing, a control is performed so that a larger amount of heat is supplied to the recording sheet in the thermal fixing than when the amount of paper dust is smaller than the permissible amount. This accelerates the melting of the wax contained in the toner forming the unfixed image and enhances the releasability of the toner.

As a result, it becomes difficult for the toner on the recording sheet to attach to the outer circumferential surface of the fixing rotator, thereby reducing the occurrence of a paper jam that is attributable to the attachment of paper dust to the fixing rotator. In this way, it is possible to reduce the occurrence of a paper jam that is attributable to the attachment of paper dust to the fixing rotator, without having a cleaning device.

In the above-described fixing device, when the amount of paper dust indicated by the obtained value is equal to or larger than the permissible amount, the control may be performed so that a fixing temperature of the fixing rotator is higher than when the amount of paper dust indicated by the obtained value is smaller than the permissible amount.

With the above-described structure, when the amount of paper dust attached to the fixing rotator becomes equal to or larger than the permissible amount, and a paper jam of recording sheet is likely to occur due to the attachment of paper dust during the thermal fixing, a control is performed so that a fixing temperature of the fixing rotator is higher and a larger amount of heat is supplied to the recording sheet than when the amount of paper dust is smaller than the permissible amount. This makes it possible to supply an amount of heat necessary for reducing the occurrence of a paper jam that is attributable to the attachment of paper dust to the fixing rotator, without increasing the time period of the thermal fixing. This it is possible to reduce the occurrence of a paper jam that is attributable to the attachment of paper dust to the fixing rotator, without reducing the productivity of the printing process as a whole.

In the above-described fixing device, when the amount of paper dust indicated by the obtained value is equal to or larger than the permissible amount, the control may be performed so that a speed at which the recording sheet passes through the fixing nip is slower than when the amount of paper dust indicated by the obtained value is smaller than the permissible amount.

With the above-described structure, when the amount of paper dust attached to the fixing rotator becomes equal to or larger than the permissible amount, and a paper jam of recording sheet is likely to occur due to the attachment of paper dust during the thermal fixing, a control is performed so that a speed at which the recording sheet passes through the fixing nip is slower than when the amount of paper dust is smaller than the permissible amount. This increases the amount of heat that is supplied to the recording sheet, and makes it possible to reduce the occurrence of a paper jam that is attributable to the attachment of paper dust to the fixing rotator, without increasing the amount of power supplied to the fixing nip, and restricting the power consumption from increasing.

In the above-described fixing device, when the amount of paper dust indicated by the obtained value is equal to or larger than the permissible amount, the control may be performed so that a distance from a trailing edge of a preceding recording sheet to a leading edge of a succeeding recording sheet passing through the fixing nip is longer than when the amount of paper dust indicated by the obtained value is smaller than the permissible amount.

With the above-described structure, when the amount of paper dust attached to the fixing rotator becomes equal to or larger than the permissible amount, and a paper jam of recording sheet is likely to occur due to the attachment of paper dust during the thermal fixing, a control is performed so that a distance from a trailing edge of a preceding recording sheet to a leading edge of a succeeding recording sheet passing through the fixing nip is longer than when the amount of paper dust is smaller than the permissible amount. This reduces the frequency with which recording sheets pass through the fixing nip, thereby reducing the amount of heat removed from the fixing nip when recording sheets pass through the fixing nip. As a result, a more amount of heat is supplied to the recording sheet than when the amount of attached paper dust is smaller than the permissible amount. This makes it possible to reduce the occurrence of a paper jam that is attributable to the attachment of paper dust to the fixing rotator, without increasing the amount of power supplied to the fixing nip, and restricting the power consumption from increasing.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device for performing a thermal fixing for fixing an unfixed image onto a recording sheet by passing the recording sheet through a fixing nip formed by a fixing rotator and a pressing member pressing the fixing rotator, the fixing device comprising:

a paper dust amount obtaining unit configured to obtain a value indicating an amount of paper dust attached to the fixing rotator;

a heater for heating the fixing rotator;

an ON/OFF switch for turning the heater on and off; and a heat supply controller configured to, when the amount of paper dust indicated by the obtained value is equal to or larger than a permissible amount, perform a control of the ON/OFF switch so that a larger amount of heat is supplied to the recording sheet in the thermal fixing than when the amount of paper dust indicated by the obtained value is smaller than the permissible amount.

2. The fixing device of claim 1, wherein the value indicating the amount of paper dust is a measured value of a surface potential in a paper-passing region of the fixing rotator.

3. The fixing device of claim 1, wherein when the amount of paper dust indicated by the obtained value is equal to or larger than the permissible amount, the control is performed so that a fixing temperature of the fixing rotator is higher than when the amount of paper dust indicated by the obtained value is smaller than the permissible amount.

4. The fixing device of claim 1, wherein the fixing rotator is an endless fixing belt.

5. An image forming apparatus having the fixing device of claim 1.

6. The fixing device of claim 1, for performing a thermal fixing for fixing an unfixed image onto a recording sheet by passing the recording sheet through a fixing nip formed by a fixing rotator and a pressing member pressing the fixing rotator, the fixing device comprising:

a paper dust amount obtaining unit configured to obtain a value indicating an amount of paper dust attached to the fixing rotator; and a heat supply controller configured to, when the amount of paper dust indicated by the obtained value is equal to or larger than a permissible amount, perform a control so that a larger amount of heat is supplied to the recording sheet in the thermal fixing than when the amount of paper dust indicated by the obtained value is smaller than the permissible amount;

wherein when the amount of paper dust indicated by the obtained value is equal to or larger than the permissible amount, the control is performed so that a speed at which the recording sheet passes through the fixing nip is slower than when the amount of paper dust indicated by the obtained value is smaller than the permissible amount.

7. An image forming apparatus having the fixing device of claim 6.

8. A fixing device for performing a thermal fixing for fixing an unfixed image onto a recording sheet by passing the recording sheet through a fixing nip formed by a fixing rotator and a pressing member pressing the fixing rotator, the fixing device comprising:

a paper dust amount obtaining unit configured to obtain a value indicating an amount of paper dust attached to the fixing rotator, the value indicating the amount of paper dust being a measured value of an optical reflectivity in a paper-passing region of the fixing rotator; and a heat supply controller configured to, when the amount of paper dust indicated by the obtained value is equal to or larger than a permissible amount, perform a control so that a larger amount of heat is supplied to the recording sheet in the thermal fixing than when the amount of paper dust indicated by the obtained value is smaller than the permissible amount.

9. The fixing device of claim 8, wherein when the amount of paper dust indicated by the obtained value is equal to or larger than the permissible amount, the control is performed so that a fixing temperature of the fixing rotator is higher than when the amount of paper dust indicated by the obtained value is smaller than the permissible amount.

10. The fixing device of claim 8, wherein when the amount of paper dust indicated by the obtained value is equal to or larger than the permissible amount, the control is performed so that a speed at which the recording sheet passes through the fixing nip is slower than when the amount of paper dust indicated by the obtained value is smaller than the permissible amount.

11. The fixing device of claim 8, wherein when the amount of paper dust indicated by the obtained value is equal to or larger than the permissible amount, the control is performed so that a distance from a trailing edge of a preceding recording sheet to a leading edge of a succeeding recording sheet passing through the fixing nip is longer than when the amount of paper dust indicated by the obtained value is smaller than the permissible amount.

12. An image forming apparatus having the fixing device of claim 8.

* * * * *